United States Patent [19]

Kamp et al.

[11] 4,323,871

[45] Apr. 6, 1982

[54] CIRCUIT PROTECTING APPARATUS INCLUDING RESETTABLE VACUUM FUSE AND SWITCH

[75] Inventors: Eugene L. Kamp, Fulton; Charles A. Popeck; Armin M. Bruning, both of Centralia, all of Mo.

[73] Assignee: A. B. Chance Company, Centralia, Mo.

[21] Appl. No.: 132,852

[22] Filed: Mar. 21, 1980

[51] Int. Cl.[3] ..... H01H 85/00

[52] U.S. Cl. ..... 337/7; 337/70; 337/144

[58] Field of Search ..... 337/7, 144–146, 337/70; 335/142; 200/144 B, 67 PK, 240

[56] References Cited

U.S. PATENT DOCUMENTS

| | | | |
|---|---|---|---|
| 3,077,525 | 2/1963 | Dyer | 337/70 |
| 3,147,353 | 9/1964 | Leonard | 337/70 |
| 3,240,901 | 3/1966 | Rodeseike et al. | 337/4 |
| 3,597,713 | 8/1971 | McClain | 200/144 B |
| 3,863,187 | 1/1975 | Mahieu et al. | 337/162 |
| 3,920,941 | 11/1975 | Hundstad | 200/144 B |
| 4,032,875 | 6/1977 | Belttary | 337/70 |
| 4,083,028 | 4/1978 | Haubein et al. | 337/144 |
| 4,158,119 | 6/1979 | Krakik | 200/240 |
| 4,168,414 | 9/1979 | Kumbera et al. | 200/67 PK |

*Primary Examiner*—Harold Broome

*Attorney, Agent, or Firm*—Schmidt, Johnson, Hovey & Williams

[57] ABSTRACT

A current-responsive, resettable, violence-free low fault range vacuum-type switch interrupter is disclosed which is especially designed for series connection with a high fault range current limiting fuse (CLF) to achieve an improved, full range circuit protecting device adapted for use in padmounted, oil filled switch gear apparatus or the like. The resettable switch includes a spring-loaded, over center toggle motive assembly along with a current-responsive, temperature sensitive, bimetallic U-shaped latching element; in the event of a fault, the element deforms and releases the motive assembly to quickly open the vacuum contacts without the violence or oil contamination associated with fuse links. Manual opening of the contacts, and resetting thereof after either manual or fault-induced contact opening, is achieved through appropriate manipulation of an external, trip-free operating handle. The switch further includes a weighted, shock-absorbing element for slowing the contacts just prior to engagement thereof during the switch closing sequence, and a novel, high-impact hammer arrangement for breaking any contact welds during the fault-induced operation of the switch. The resettable switch-CLF combination is synergistically coordinated such that the switch is operated when it experiences the characteristic let through current incident to the operation of the CLF, so as to enhance the overall protective result. In three-phase systems where each phase conductor is separately protected, the respective switches may be advantageously gang coupled to operate together, even if only one conductor experiences a fault.

25 Claims, 15 Drawing Figures

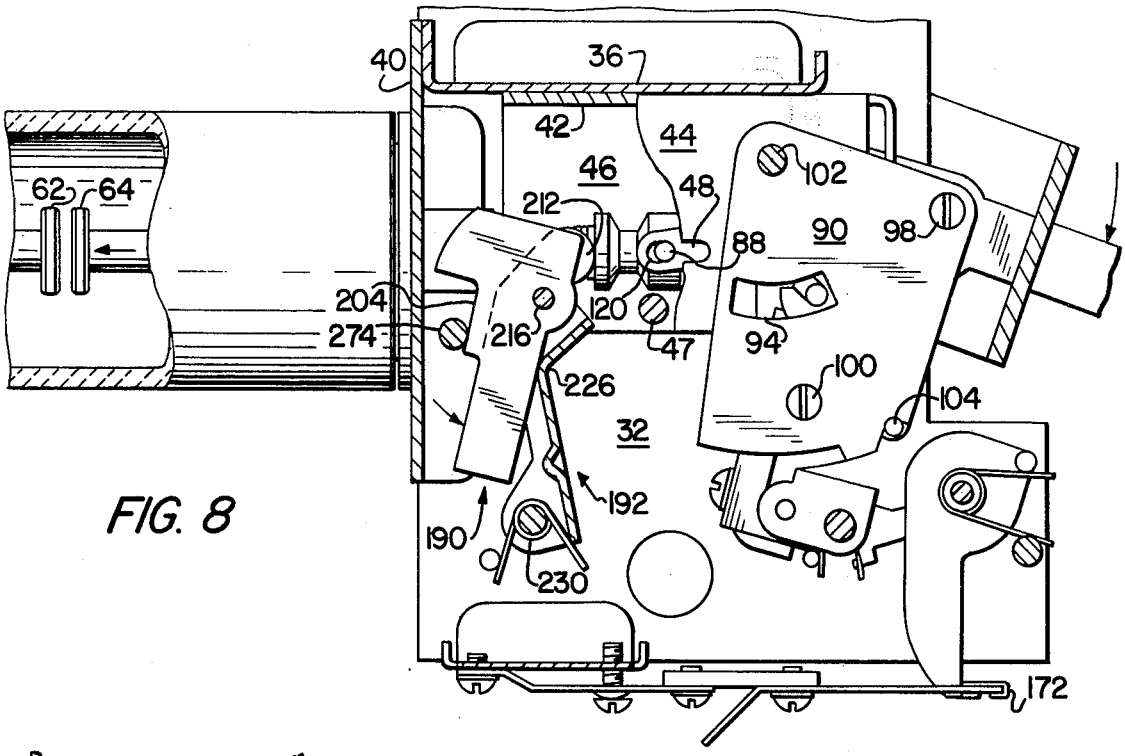
FIG. 8
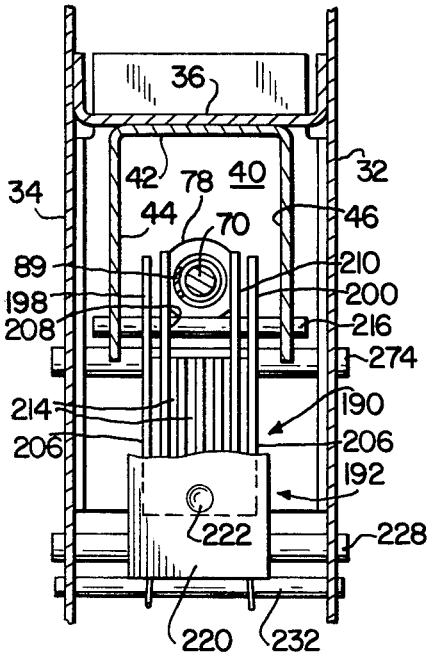
FIG. 5
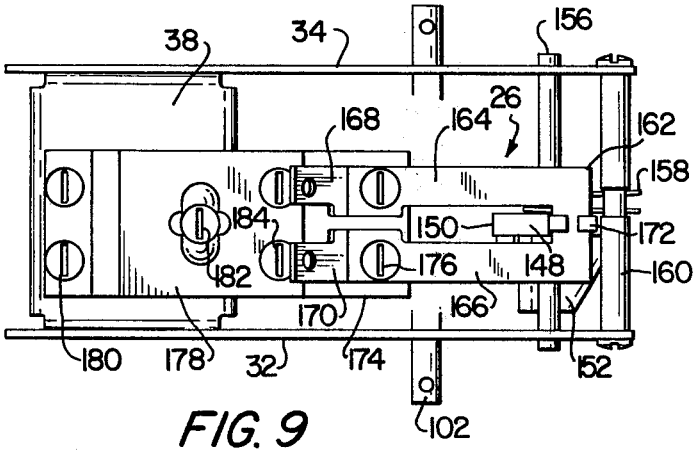
FIG. 9
FIG. 10
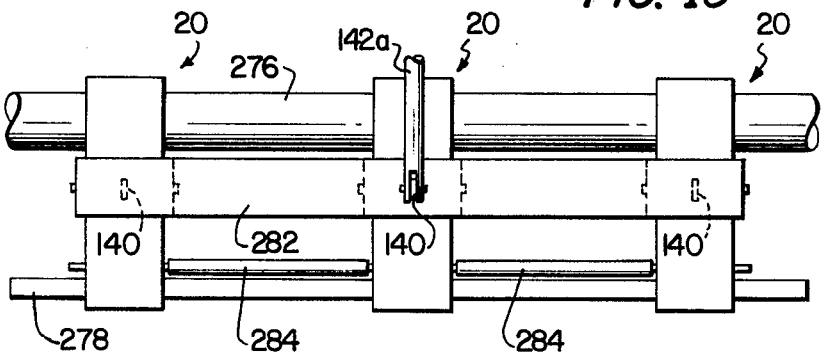

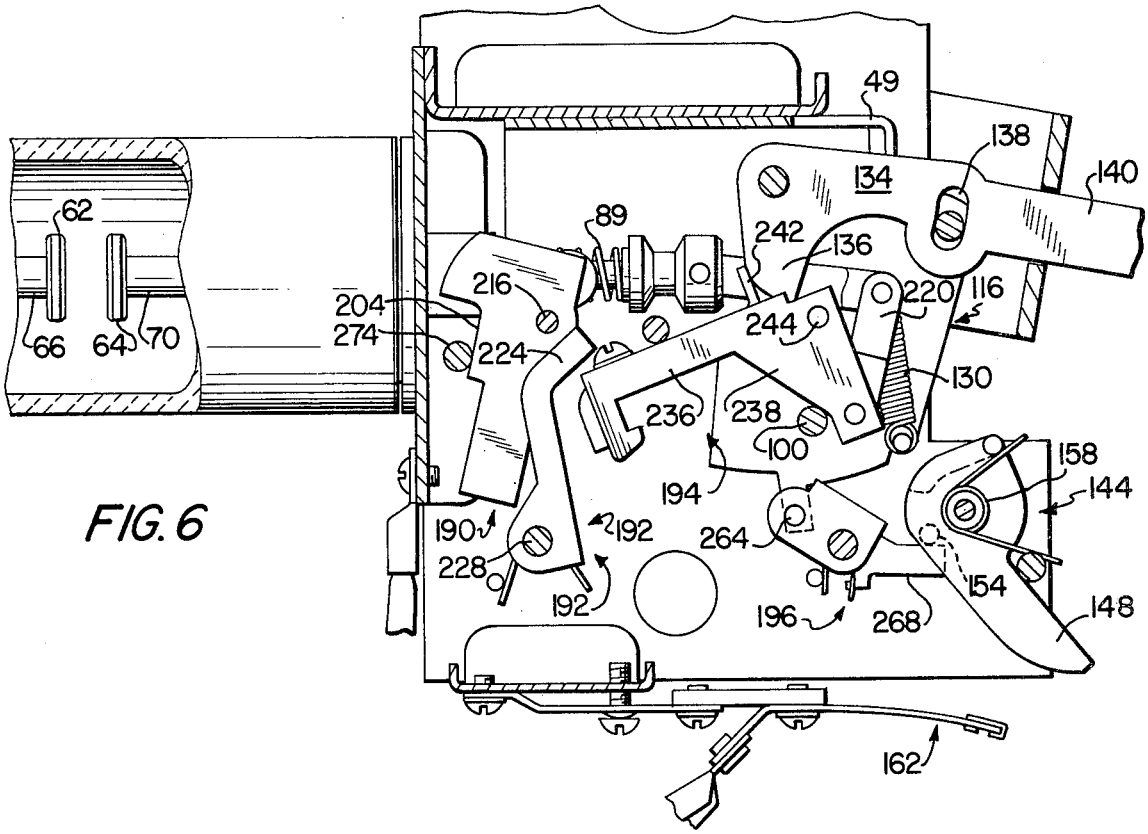
FIG. 6
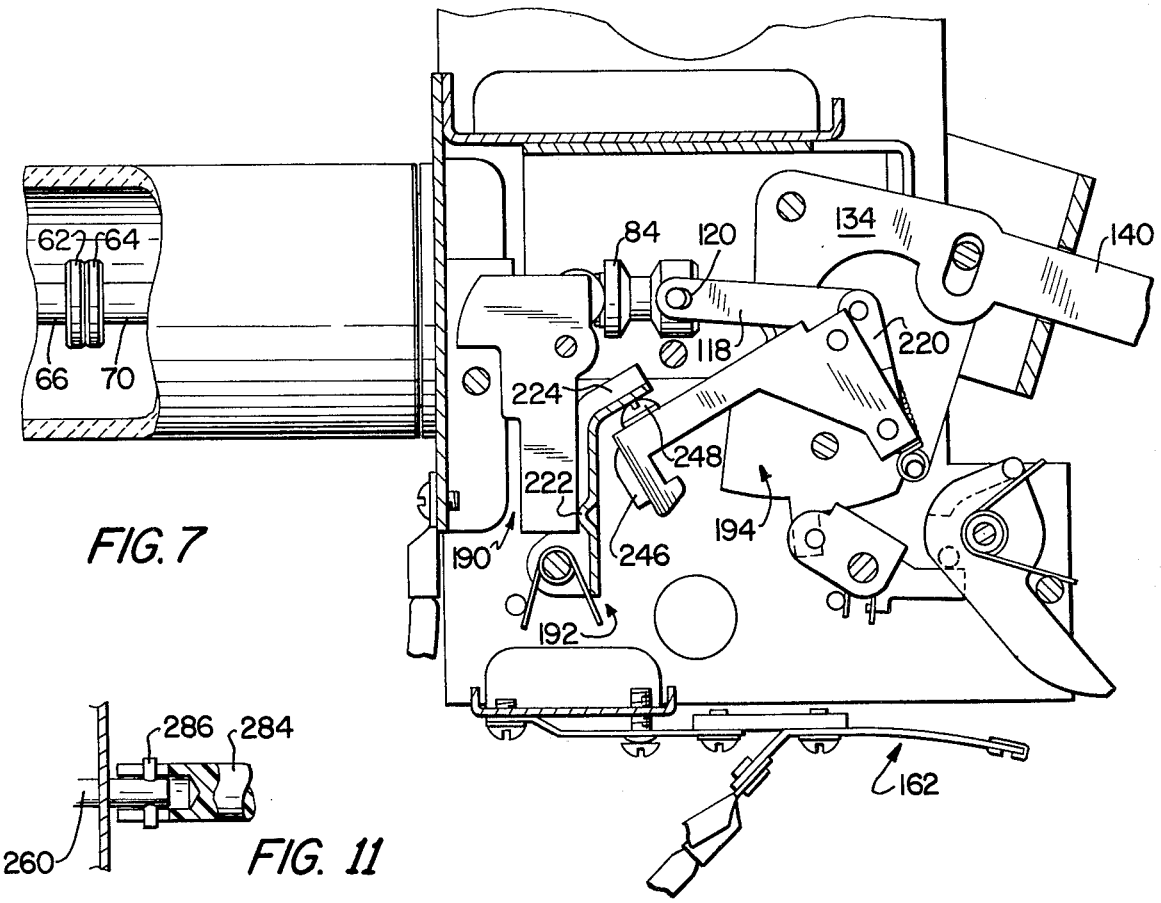
FIG. 7
FIG. 11

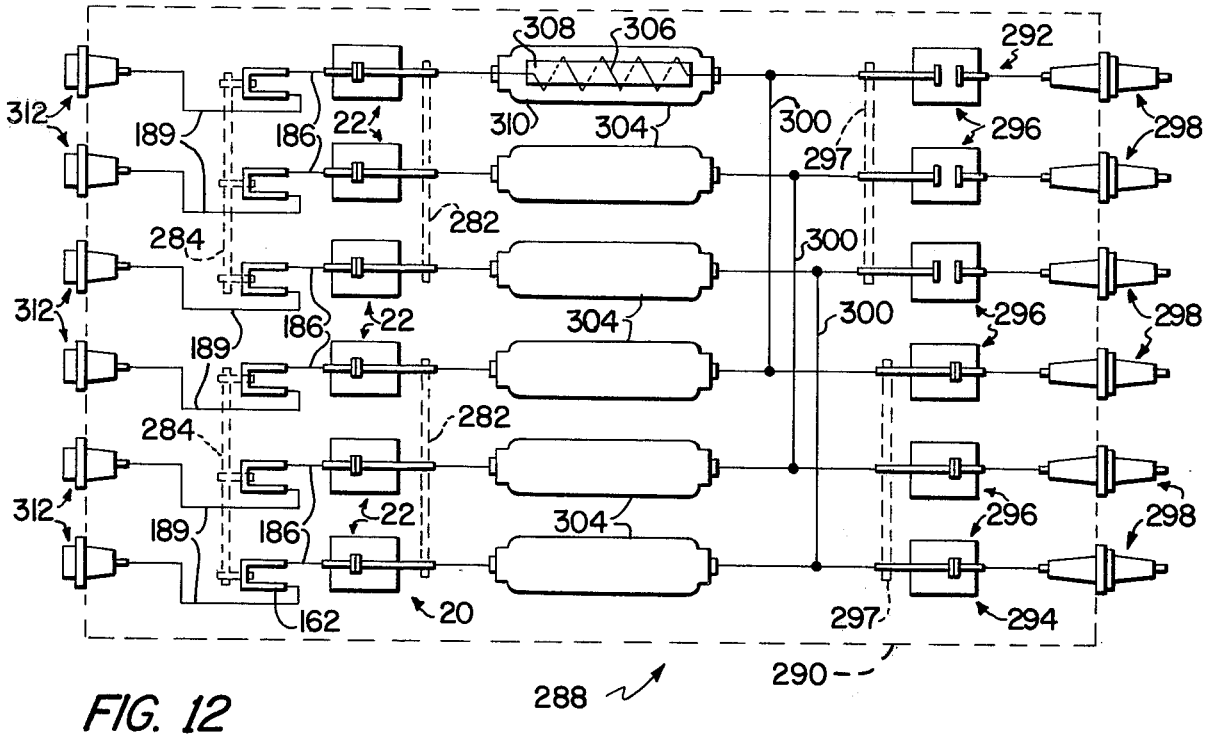
FIG. 12
FIG. 13
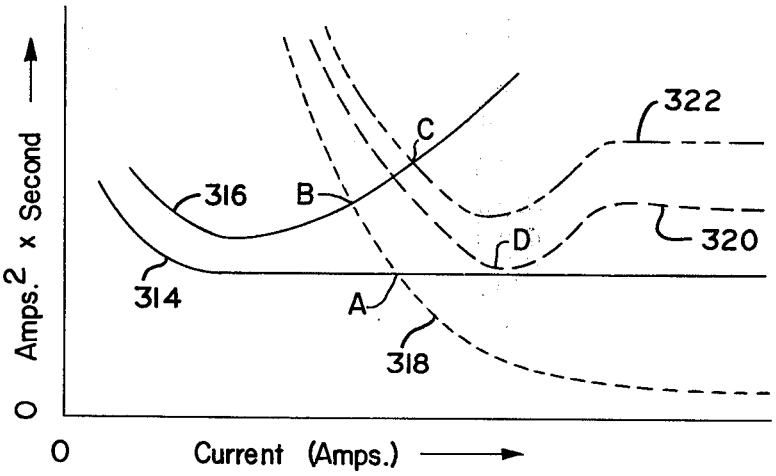
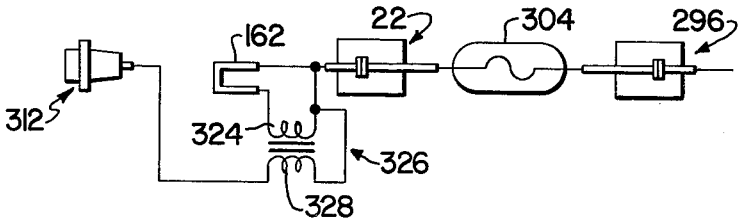
FIG. 14
FIG. 15
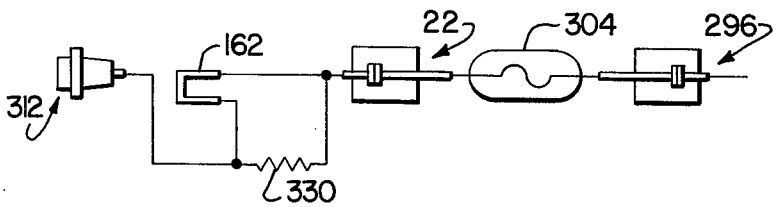

CIRCUIT PROTECTING APPARATUS INCLUDING RESETTABLE VACUUM FUSE AND SWITCH

BACKGROUND OF THE INVENTION

1. Field of the Invention

The present invention is concerned in one aspect with a resettable vacuum-type switch interrupter especially designed for protecting electrical distribution circuits from the effects of fault currents. In another aspect, the invention comprehends a full range protective device including the resettable vacuum switch along with a series-related current limiting fuse (CLF) to give a coordinated, full range protective device. The switch interrupter component has a number of unique features which render it particularly advantageous for use in oil-filled equipment such as padmounted switchgear and the like. Such features include the preferred violence-and contamination-free operation of the interrupter, high mechanical advantage weld breaking capabilities in both the manual and fault-produced modes of switch contact opening so as to positively assure that the switch contacts open, and gang operation of respective switches in a three-phase system so as to prevent a situation where the current path through one phase conductor is broken while the remaining two phase conductors remain energized.

2. Description of the Prior Art

U.S. Pat. No. 4,083,028 (which is hereby incorporated by reference herein) discloses a double-fused vacuum switchgear used in the fault protection of electrical distribution circuitry. Broadly speaking, the apparatus disclosed in this patent includes a fuse assembly having a current limiting fuse and an expulsion-type fuse link in series. The fuse assembly is in turn coupled in series with a switch element in a dielectric filled tank. The apparatus disclosed in U.S. Pat. No. 4,083,028 represents a significant breakthrough in the art and provides excellent, full range coordinated circuit protection. However, the subject device has an electrical duty rating making it inappropriate for use in some modern day high voltage and amperage systems. For example, the prior device is admirably suited for protecting distribution circuits rated at 15 kV and up to 200 amps, but is not designed for higher rated systems now coming into use, e.g., 35 kV and 200 amps or more.

For example, if an expulsion-type fuse link-CLF arrangement is used in such higher rated systems, fault-induced fusing of the link may significantly contaminate the surrounding dielectric material and may also be unacceptably violent. Further, in three-phase circuits only a single phase may be interrupted by fuse actuation, while the remaining phases are energized. This is dangerous inasmuch as downstream three-phase electrical equipment can be damaged or destroyed in such a case. This single phase fusing problem is compounded because no indication is given of which phase conductor has experienced the fault, thereby necessitating time-consuming checking of all of the protective devices associated with each phase conductor after every fault occurrence.

Also, it will be appreciated that the device disclosed in U.S. Pat. No. 4,083,028 is not resettable; that is to say, actuation of the low range fuse link necessitates manual removal of the fuse assembly from the tank and replacement of the link. This represents a cost both in terms of replacement fuses but more importantly in time and labor.

Finally, the fuse link-CLF protective combination cannot be used as a load break switching element without considerable modification and expense. This latter factor is particularly pertinent when it is considered that the recent trend is to prohibit manual load break operations (e.g., by simply grasping an external load break elbow with a hotline tool and pulling on the same to break the load), so that the capability of breaking loads without resorting to manual expedients would be a significant advantage.

There is accordingly a real need in the art for an improved system for protecting higher rated electrical distribution circuits and which overcomes the potential problems of oil contamination, violent operation, single phase fusing, load breaking and lack of easy resettability.

SUMMARY OF THE INVENTION

The present invention is concerned with a resettable vacuum-type switch interrupter which is particularly designed for use with a high range CLF to produce a coordinated, full range circuit protective device which is completely violence free in normal operation, does not contaminate a surrounding dielectric material, and is capable of safely protecting circuits having relatively high voltage and current ratings.

The resettable switch of the present invention broadly includes a vacuum contact assembly including bottle or other means defining a substantially evacuated chamber, with a pair of normally closed electrical contacts within the chamber. At least one of the electrical contacts is shiftable for opening and closing of the contact pair to alternately interrupt and establish a current path therethrough. Mechanism operably coupled to the contact assembly is provided for opening the contact pair when a fault of predetermined magnitude is experienced by the interrupter-protected circuit. The mechanism includes a spring biased, over center toggle motive assembly operably coupled to a shiftable contact shaft, along with a latching element electrically interposed in the circuit and serving to releasably hold the motive assembly in the biased, cocked position thereof. The latching element preferably is in the form of a current-responsive, temperature sensitive bimetallic element which is constructed for heating when it experiences a fault current and, in response to and as a direct result of such heating, for changing its physical configuration for unlatching purposes. Although use of such a bimetallic latching element is preferred, those skilled in the art will recognize that other alternatives are possible.

In addition to fault-induced tripping of the switch interrupter of the invention, structure is also provided for selective manual opening and closing of the vacuum contact pair. This structure includes an appropriate external operating handle, and the latter can also be employed to reset (i.e., reclose) the vacuum contacts when the latter have been opened either manually or in response to a fault current.

The resettable vacuum switch interrupter of the invention is particularly designed for series connection with a current limiting fuse. Such a CLF is of conventional construction and includes a housing and a silver fusable element within the housing which is designed to fuse in response to a relatively high magnitude fault current. A suitable CLF is disclosed in U.S. Pat. No.

3,863,187, and the latter patent is incorporated by reference herein. Desirably, the CLF and vacuum switch interrupter are cooperatively designed and configured such that the switch interrupter operates upon experiencing the let through current resulting from operation of the current limiting fuse. In this manner the switch interrupter always operates in response to operation of the current limiting fuse.

A common problem associated with vacuum-type switch contacts in that they sometimes become welded together during use. This can present an extremely dangerous situation if a lineman seemingly opens the switch contacts by manipulation of an external operating handle, while in fact the switch contacts remain closed. In such a case the lineman may assume that the contacts are open and the circuit broken, when in fact the circuit remains fully energized. In order to overcome this problem, the switch interrupter of the present invention provides structure for positive weld breaking in both the manual and fault-induced modes of operation. In the latter case a unique, high mechanical advantage hammer assembly is provided which operates in response to unlatching of the motive assembly to deliver a strong (on the order of 1,000 lbs.) impact blow against the shiftable contact shaft, in order to positively assure opening of the contacts.

In three-phase circuits wherein respective vacuum interrupters in accordance with the invention are interposed in the separate phase lines, a mechanical connection in the form of elongated rods between separate switch interrupters and operably coupled to the motive assemblies thereof can be provided for gang operation of the switch interrupters. Thus, when one phase conductor experiences a fault sufficient to actuate the associated switch interrupter, the remaining switch interrupters are likewise actuated. This prevents a situation where one or more of the phase conductors remain energized in the event of a fault in another phase conductor.

BRIEF DESCRIPTION OF THE DRAWINGS

FIG. 5 is a vertical sectional view taken along line 5—5 of FIG. 1;

FIG. 6 is a view similar to that of FIG. 1, but illustrates the tripped orientation of the operating mechanism subsequent to experiencing a fault current;

FIG. 7 is a view similar to that of FIG. 6, and depicts the weld breaking operation of the trip hammer assembly;

FIG. 8 is a view similar to that of FIGS. 1 and 2, but illustrates the closing sequence of the switch at the instant of impact against the weighted, shock-absorbing weld break hammer;

FIG. 9 is a bottom view of the structure shown in FIG. 8 and illustrates the U-shaped bimetallic latching element;

FIG. 10 is an essentially schematic plan view of three ganged switch interrupters for use in protecting three-phase distribution circuits;

FIG. 11 is an enlarged fragmentary view illustrating the gang connection between the respective switch interrupters;

FIG. 12 is an essentially schematic plan view illustrating the electrical connection between the coordinated full range protective device of the present invention and conventional switch gear in a three-phase, padmounted, oil-filled circuit distribution device;

FIG. 13 is a graphical representation of typical fault-clearing responses of the full range coordinated protective devices of the invention;

FIG. 14 is a schematic representation of an alternate method of electrically connecting the bimetallic latching element of the invention into a circuit to be protected; and FIG. 15 is a schematic view in the nature of FIG. 14 and illustrates another method of electrically connecting a bimetallic latching element into a circuit to be protected.

DESCRIPTION OF THE PREFERRED EMBODIMENTS

Figures 1, 4:
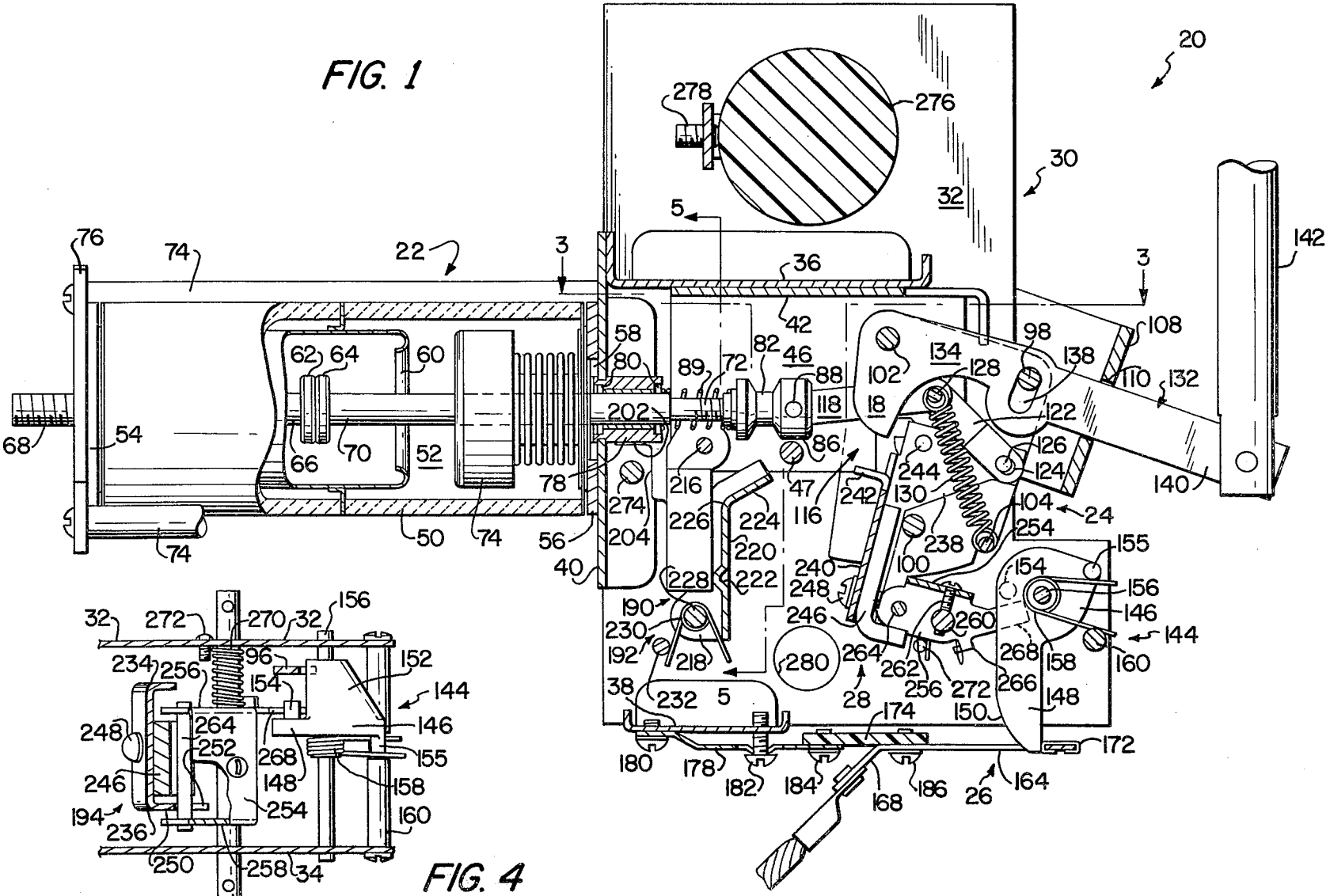
FIG. 1 is a longitudinal vertical central section of a resettable vacuum switch interrupter operating mechanism, shown in the switch closed position thereof.
FIG. 4 is a fragmentary horizontal sectional view taken along line 4—4 of FIG 2.

Turning now to the drawings, a resettable vacuum switch interrupter 20 in accordance with the invention is illustrated in FIGS. 1–9 and broadly includes a vacuum contact assembly 22, a spring biased, over center toggle operating mechanism 24 including a latching element 26, and a trip weld break hammer assembly 28. The assembly 22, mechanism 24, element 26 and hammer assembly 28 are housed within and supported by mounting structure 30 which further is designed to support the overall interrupter 20 in a dielectric filled tank.

In more detail, the structure 30 includes a pair of laterally spaced, apertured side plates 32 and 34, and opposed, flanged end plates 36, 38 respectively secured to the adjacent faces of the plates 30, 32. A contact assembly mounting plate 40 is similarly secured to the plates 32, 34, and to plate 36 (see FIG. 1). The structure 30 also includes a stationary U-shaped bracket 42 fixedly secured to plate 36 as illustrated and having a pair of spaced apart legs 44, 46 provided with a transverse support 47 therebetween, respective elongated guide slots 48 therein, and an endmost vertical slot 49.

Vacuum contact assembly 22 is of conventional construction and includes an enclosed, cylindrical vacuum bottle 50 presenting a substantially evacuated internal chamber 52 therewithin. The bottle 50 is formed of ceramic tubular shell closed by means of apertured metallic end caps 54, and an opposed metallic end cap 56 having a central aperture 58 therethrough. A hollow metallic housing 60 is located within the chamber 52 and surrounds a pair of metallic electric contacts 62, 64. A stationary soft copper shaft 66 supports contact 62 and extends through end cap 54 and presents a threaded connection end 68. In a similar fashion, an axially shiftable soft copper shaft 70 supports contact 64 and extends through aperture 58 and plate 40 and presents a threaded outermost connection end 72. Conventional bellows 74 are also disposed within chamber 52 in surrounding relationship to shiftable shaft 70 in order to ensure maintenance of vacuum conditions within chamber 52 during opening and closing operations of the contacts 62, 64.

Assembly 22 is supported by screws connecting plates 56 and 40, and also by means of two spaced struts 74 attached between a mounting plate 76 and plate 40. As best seen in FIG. 1, the plate 76 is in engagement with the outermost butt end of bottle 50 and is apertured to receive connection end 68 of shaft 66.

A tubular multilam electrical contact 78 of known construction is affixed to plate 40 at the area of the shaft-receiving aperture thereof. The contact 78 includes a conductive, louvered, annular metallic band having a series of transversely extending louvers each being canted relative to the normal circumferential surface of the band. In addition, a pair of insulative washers 80 are provided at the respective ends of the contact 78 for maintaining the louvered band in its proper position. An adapter nut 82 is threaded on end 72 of shaft 70 and includes a pair of spaced, radially enlarged segments 84, 86. The segment 86 is provided with a transversely extending guide pin 88 therethrough. End 72 of shaft 70, as well as adapter nut 82, are slidably disposed between the legs 44, 46; moreover, the pin 88 is received within the elongated slots 48 (see FIG. 3) in order to guide shaft 70 during reciprocation thereof. Finally, a coil spring 89 is disposed about end 72 between outer washer 80 and the flattened face of segment 84. Spring 89 is of sufficient biasing strength to substantially counteract the atmospheric pressure effect of bellows 74 on rightward shifting of shaft 70 as viewed in FIG. 1.

Operating mechanism 24 includes a pivotal carriage formed of a pair of spaced, slotted sidewalls 90, 92 which are respectively disposed adjacent the outer surface of a corresponding leg 44, 46. Each sidewall 90, 92 is provided with an arcuate slot 94, and is similarly configured save for the fact that sidewall 92 is provided with an outwardly extending, rectangular cam reset leg 96 (see FIG. 2) which is important for purposes to be explained. The respective sidewalls 90, 92 are interconnected by means of a pair of transversely extending cross pins 98, 100. The sidewalls 90, 92 are pivotal with an elongated, transversely extending pivot pin 102 which extends through the legs 44, 46, sidewalls 90, 92, and plates 32, 34. Finally, a transverse spring mounting pin 104 extends between and is coupled to the sidewalls 90, 92.

Outermost U-shaped yoke 106 also forms a part of mechanism 24 and includes a bight 108 slotted as at 110 and spaced apart legs 112, 114 respectively disposed adjacent the outer surfaces of side plates 32, 34. The yoke legs 112, 114 are mounted on the outermost ends of pivot pin 102, such that the yoke 106 pivots about the axis presented by the pivot pin.

An over center toggle linkage 116 is disposed between the legs 44, 46, and includes two sets of identical, side-by-side linkages. Specifically, each linkage includes a first link 118 provided with a lost motion slot 120 (see FIG. 8) which receives the adjacent end of guide pin 88 on segment 86, along with a second link 122 pivotally connected to the associated link 118. The link 122 includes a slot 124 at the end thereof remote from link 118. Respective mounting pins 126 are provided for pivotally and slidably securing the link 122 to adjacent sidewalls of the impact hammer later to be described, with the pins 126 being received within the slots 124. Pivotal interconnection of the links 118 and 122 is effected by means of a transversely extending pin 128 which defines the pivot axis for the toggle linkage 116.

A pair of identical, side-by-side coil springs 130 extend between and are connected to pin 128 and spring mounting pin 104. As will be explained in detail hereinafter, the springs 130 serve as the source of motive energy to open the contacts 62, 64.

An operator 132 is provided with mechanism 24 and includes an irregularly shaped plate 134 presenting a beak-like weld break section 136 along with an elongated slot 138 therethrough. The plate 134 is pivotally secured to pin 102. An elongated, metallic arm 140 extends outwardly from plate 134 and through the slot 110 in yoke bight 108. A handle 142 is coupled to the outermost end of arm 140 and serves as a means for manually opening the contacts 62, 64 as well as for resetting the interrupter 20. Such operations will be described in detail below.

An integral, synthetic resin cam member 144 also forms a part of mechanism 24 and includes a rounded main body portion 146 and a depending, elongated leg 148 presenting an arcuate cam surface 150. Main body portion 146 includes an enlarged, laterally extending, tapered projection 152 (see FIG. 4), while a stud 154 projects in a similar direction from the upper end of leg 148. A spring-engaging projection 155 extends from the face of portion 146 remote from stud 154.

Cam member 144 is pivotally supported between plates 32, 34, by means of an elongated, transversely extending mounting pin 156. The cam member is further biased for counterclockwise movement thereof as viewed in FIG. 1 through the medium of torsion spring 158. The legs of spring 158 are respectively in engagement with a spacer 160 extending between and coupled to plates 32, 34, and projection 155.

Latching element 26 is preferably in the form of a substantially U-shaped bimetallic element 162 having spaced apart legs 164, 166 and respective, angularly oriented connector portions 168, 170 associated therewith. A brass reinforcement 172 is crimped about the bight portion of element 162 and engages the leading edge of cam member leg 148, in order to hold the latter in its cocked position illustrated in FIG. 1. The bimetallic element 162 is of known construction and includes at least two layers of metallic material having dissimilar coefficients of thermal expansion. Therefore, upon experiencing a rise in temperature (e.g., derived from resistance in the event of a fault current), the bimetallic element will deform in an entirely predictable manner in order to unlatch cam member 144 and permit pivoting thereof in a counterclockwise manner; this actuates the entire operating mechanism 24 in a manner to be explained. Although a wide variety of bimetallic elements can be used to good effect in the invention, three-component products sold by the Texas Instruments Corporation under the designation "F-90R" or by the G.T.E. Corporation as "No. 1090" have proven satisfactory. These materials have a thickness of 0.045 thousandths of an inch with the high expansion side thereof formed of a stainless steel alloy including 22% iron and 3% chromium. The low expansion side on the other hand is a stainless steel alloy (Invar) containing 36% nickle and 64% iron. The intermediate layer is a copper-silver alloy containing 98% copper and 2% silver.

The bimetallic element 162 is secured to an insulative plate 174 by means of mounting screws 176. The plate 174 is in turn secured to and supported by a cantilever spring 178 secured to plate 138 by means of screws 180 and an adjustment screw 182. Connection between cantilever spring 178 and plate 174 is effected through use of screws 184.

A conductive electrical braid 186 is secured at respective ends thereof to connecter portion 170 of element leg 166, and to plate 40 by means of screw 188. A second electrical braid 189 is operatively secured to connection portion 168 of leg 164, and to associated electrical apparatus forming a part of the circuit to be protected. The electrical connections to element 162 are preferably on the high expansion side thereof, in order to keep heat-up time to a minimum and lower response time.

Hammer assembly 28 broadly includes a weighted weld break lever 190 (which also serves as an energy shock absorber during contact closing as will be described), a multiplier lever 192, impact hammer 194, and a hammer latch 196. The purpose of assembly 28 is to ensure that any weld between the contacts 62, 64 will be broken during the fault-induced operation of interrupter 20.

To this end, the lever 190 includes a pair of laterally spaced apart, outermost sidewalls 198, 200, of irregular configuration and presenting angularly oriented, rearward bearing surfaces 202, 204, as well as a depending portion 206. A pair of inboard, segment-engaging walls 208, 210 are also provided and include respective, forwardly projecting, rounded portions 212 disposed for engagement by the flattened surface of shaft-mounted segment 84. Finally, the lever 190 includes a series of riveted lower plates 214 disposed beneath the upstanding portions of walls 198, 200 and 208, 210, for the purpose of increasing the mass of lever 190. Lever 190 is mounted for pivotal movement about a transverse axis through the medium of support pin 216 operatively coupled to the legs 44, 46 and extending through the upstanding portions of the sidewalls and inboard walls of the lever.

Multiplier lever 192 is disposed adjacent lever 190 and includes a pair of side flanges 218 in straddling relationship to the lever 119 which are interconnected by means of a central, normally upright wall 220. Wall 220 includes a central, projecting dimple 222 which normally engages the lower margin of the weighted lever 190 (see FIG. 5). The upper portion of 192 is angularly oriented and presents a stretch 224 disposed at an obtuse angle relative to the depending portion of wall 220, as well as a rounded bearing corner 226. The lever 192 is mounted for pivotal movement about a shaft 228 extending between and supported by the outer sidewalls 32, 34 of interrupter 20.

Further, the lever 192 is biased for pivoting in a counterclockwise direction as viewed in FIG. 1 through a torsion spring 230. One leg of spring 13 engages the lower marginal edge of wall 220 whereas the other leg thereof engages a transverse stationary pin 232 supported on opposite ends thereof by the sidewalls 32, 34.

Hammer 194 includes a pivotally mounted main bracket presenting a pair of spaced sidewalls 234 and 236 each having an irregularly shaped, somewhat triangular upper portion 238. A back wall 240 interconnects sidewalls 234, 236 and includes an outwardly projecting, uppermost ear 242 between the sidewalls. Respective mounting studs 244 coined into the sidewalls 234, 236 are received by the adjacent legs 44, 46 to pivotally support the hammer. The rightmost ends of the triangular portions 238 as viewed in FIG. 1 include the inwardly extending mounting studs 126 described above. Such studs are received within the slots 124 provided in the ends of toggle links 122, as best seen in FIG. 1, so as to operatively couple the toggle linkage 116 with hammer 194. An elongated weight 246 is secured to back wall 240 by means of screw 248 between sidewalls 234, 236, for increasing the mass of hammer 194. Finally, sidewall 236 includes a lower projecting segment 250 provided with a marginal dog 252.

Hammer latch 196 is in the form of a bracket including a central top wall 254 and a pair of spaced, depending sidewalls 256, 258. The bracket is fixedly secured to an elongated, transversely extending, axially rotatable shaft 260 extending through and beyond the respective sidewalls 32, 34, such connection being effected by means of set screw 262. In addition, a fixed, transverse latching pin 264 extends between and is supported by the sidewalls 256, 258, and is oriented for engaging dog 252 in order to normally latch hammer 194 in its FIG. 1 position.

Finally, sidewall 256 includes an integral lower spring mount 266 as well as a projecting arm 268 which extends below and adjacent stud 154 forming a part of cam member 144. A torsion spring 270 is operatively disposed about shaft 260 and serves to bias latch 194 in a counterclockwise direction as viewed in FIG. 1. The legs of spring 270 are respectively in engagement with spring mount 266, and a screw 272 provided in sidewall 32.

As noted above, interrupter 20 is provided with structure for assuring that contacts 62, 64 can be quickly and safely closed without deforming the soft copper contact shafts 66, 70. This function is obtained through the medium of weighted weld break lever 190, and particularly the bearing surfaces 202, 204 thereof. In addition, an elongated, transversely extending shaft 274 is provided which extends between and is supported by the side plates 32, 34.

Interrupter 20 can be used in either single phase or three phase contexts. In a single phase situation, the interrupter may be disposed in a switchgear or like apparatus, and supported by means of an elongated, insulative rod 276 which extends through appropriate apertures in the side plates 32, 34. Conventional set screw means 278 operatively coupled to the side plates can be employed for securing the device to the rod 276.

Braid 189 can serve as a source conductor for the interrupter, whereas a load conductor can be attached to stud end 68. A continuous current path is thereby established through braid 189, bimetallic element 162, braid 186, plate 40, contact 78, shaft 70, contact 64, contact 62 and shaft 66.

In three phase circuits (see FIGS. 10 and 11) separate interrupters 20 are provided for each phase conductor. In such a case the respective interrupters 20 are again supported on rod 276 in spaced relationship to one another. In addition however, a secondary rod 278 is passed through lower apertures 280 provided in the side plates 32, 34, in order to give additional support. In three phase circuitry, it is often desirable to gang the respective interrupters 20 for substantially simultaneous operation thereof in both a manual opening and closing sequence, and in fault-induced operation. To this end, the respective operating arms 140 of the interrupters are operatively connected by means of an elongated link 282, and an operating handle **142*a* is secured to the central interrupter 20. The handle 142*a* would characteristically pass through a surrounding wall of the enclosure housing the ganged interrupters 20, for manual opening and closing of the interrupters in unison. Further, a pair of linkage rods 284 are respectively operatively coupled between the three interrupters 20 for gang operation thereof in a fault situation. Specifically, each linkage rod 284 is operatively secured to the adjacent, apertured ends of the shafts 260 by means of locking pins 286 (see FIG. 11), so that the respective shafts 260** will rotate essentially in unison.

The separate source side phase conductors making up the three phase circuit are connected to an associated interrupter 20 by connection thereof to a corresponding braid 189 or the like. In this manner, the current paths through the separate interrupters 20 for each phase are the same as described in connection with a single phase hookup; accordingly, these current paths need not again be described.

Referring now to FIG. 12, a schematic illustration of a preferred switchgear apparatus 288 in accordance with the invention is given. The specifically depicted switchgear apparatus 288 is of the padmounted variety, but it is to be understood that the apparatus of the present invention can be used in a wide variety of contexts, e.g., on pole-mounted equipment and/or in conjunction with transformers and other transmission and distribution devices. Apparatus 288 includes a conventional enclosing tank 290 adapted to hold a supply of fluid dielectric material such as oil, and provided with an openable, normally locked lid (not shown). Two banks of primary vacuum switches 292 and 294 are disposed within tank 290 and each includes three separate phase line vacuum switches 296 of identical construction and operational characteristics. The three switches in each bank are operatively coupled for gang operation thereof by means of appropriate links 297 of known construction. Six primary line bushings 298 extend through one end wall of tank 290 and are respectively operatively coupled in series to one of the phase line switches 296.

The load sides of the respective switches 296 are in turn electrically coupled in series with corresponding current limiting fuses 304, and the usual buss conductors 300 are connected between corresponding pairs of switch elements in each bank 292, 294.

Each current limiting fuse 304 is preferably of the high range variety (i.e., constructed to actuate only during high level faults) and is of the type disclosed in referenced U.S. Pat. No. 3,863,187. In general, each fuse 304 includes an elongated silver fusable element 306 spirally wound about a lightweight, finned synthetic resin saddle member 308 and disposed within a sealed housing 310 along with pulverulent arc-suppressing silica sand. In addition, the internal fuse assembly is encapsultated within a conventional synthetic resin encapsulant for ensuring that current limiting fuse 304 is air-and oil-tight. The action of the current limiting fuse 304 is silent and substantially nonventing as all of the energy of interruption is retained within the sealed housing thereof. Further details of construction of the preferred limiting fuse 304 can be found in U.S. Pat. No. 3,863,187.

The load sides of the respective CLF's are electrically connected to corresponding interrupters 20 in accordance with the invention, and specifically to the ends 68 of the stationary shafts 66. Braids 186 are employed to connect the associated bimetallic element 162 of each interrupter 20 into the phase circuit and to complete the current paths through the interrupters. In like manner, braids 189 connected to the remaining element legs (and thus to the load sides of the respective interrupters 20) are employed for coupling to corresponding tap line bushings 312 which extend through a wall of tank 290 remote from primary line bushings 298.

It will also be understood that a variety of other electrical hookups within tank 290 are also possible; e.g., the interrupters 20 could be directly connected to the switches 296, with the CLF's on the load sides of the interrupters 20. Further, essentially all of the apparatus within tank 290 is normally immersed in oil or other suitable fluid dielectric material.

As can be appreciated from a study of FIG. 12, switch gear 288 is especially adapted for use in so-called "loop" electrical systems either of the open or through variety. In such systems a plurality of switchgears could be located between separate substations with the underground electrical line extending between the substations and electrically interconnecting the respective switchgears in series through the banks 292, 294 of switch element in each switchgear. In addition, tap or branch line conductors attached to the load side (bushings 312) of the switchgear apparatus serve to distribute the electrical power from these substations. Through the use of a series of switchgears 288, it is possible to feed all of the branch circuits from one terminal substation, in the event that the other substation becomes inoperative. In more normal situations however, one bank of a selected switchgear could be left open so that the load on the substation is shared with each receiving certain of the branch circuits. During fault situations, however, the protective apparatus within switchgear 288 (i.e., the interrupters 20 and possibly the current limiting fuses 304) come into play, and such operation will be described in detail below.

In the preferred forms of the invention, the current limiting fuses 304 should be "coordinated" with the interrupters 20. That is to say, the interrupter 20 is especially designed to actuate when a relatively low level fault current is experienced, whereas the current limiting fuses are designed to actuate in a relatively rare occurrence of high level faults. Further, in order to increase the protective function, the interrupter 20 should be designed to activate upon experiencing the characteristic let through current associated with the operation of the series-related current limiting fuse.

Referring to FIG. 13, a qualitative graphical representation of the $I^2t$ versus current curves for the interrupter-CLF protective device in accordance with the invention is illustrated. In this graph, branched curve 314 is the minimum melting curve for the interrupter 20 (which represents the minimum energy needed to raise the bimetallic element to its trip temperature), and curve 316 is the total clearing curve for the interrupter 20 (maximum energy experienced before the interrupter clears the fault). Curve 318 is the minimum melt curve for the CLF, whereas curve 320 is the minimum clear curve for the CLF, and curve 322 is the total clearing curve for the CLF. The coordination of the interrupter 20 and CLF is indicated by the crossover points labeled A–D, inclusive. For example, any time the $I^2t$ energy exceeds that necessary to heat bimetal to its tripping temperature, the interrupter 20 will trip to open the circuit. This occurs when the $I^2t$ value is above curve 314. If the $I^2t$ is less than the minimum melt of the CLF then the interrupter only will operate (such corresponding to all points to the left of point "B", which is the intersection of the interrupter total clear and the CLF minimum melt). Between points "B" and "C" (the latter being the intersection of the interrupter total clear and the CLF total clear) is an area of uncertainty where the interrupter will always open and the CLF may blow. Rightwardly of point "C" and above curve 314 the interrupter and the CLF will both always open.

To summarize, the following facts are key to the proper coordination operation of the interrupter-CLF combination:

(1) Below and to the left of point "B" the interrupter only will operate and thus clear faults of relatively low magnitude, and the CLF will not blow;

(2) At $I^2t$ values above point "C" the CLF will operate and clear the circuit before the interrupter contacts open. Currents above point "C" are beyond the interrupting capacity of the interrupter; and (3) Inasmuch as the minimum total clearing curve for the CLF is above the minimum melting curve for the interrupter, the latter will operate in response to experiencing the characteristic let through current of the CLF. As such, operation of the interrupter is assured over the full range of faults. Thus, interrupter operation even in high level fault situations removes potential from the blown CLF and reduces or eliminates the possibility of a restrike.

The structure depicted in FIG. 12 illustrates the separate bimetallic elements 162 in direct series relationship with the separate phase lines. FIGS. 14 and 15 illustrate other methods of operatively coupling the bimetallic elements into a circuit to be protected.

For example, FIG. 14 depicts a case where the bimetallic element 162 is in series with the primary 324 of a current transformer 326, the secondary 328 of which is coupled to an associated bushing 312. The purpose of this arrangement is to allow use of a single bimetallic element 162 for all current ratings, with transformer 326 being variable and field replaceable. The transformer 326 may be designed to saturate its magnetic core to provide a limit as to how much energy the element 162 could receive during fault situations, thus protecting the element 162 from excessive current during interruption of very high energy faults.

In FIG. 15 the situation is much the same as in FIG. 14, except that the transformer is replaced by a resistance shunt 330 in parallel with element 162 and in series with the interrupter 20 and bushing 312. This would also allow use of a single element 162 for all ratings, with shunt 330 being variable and field replaceable at less cost than a current transformer; however, no high energy limit would be provided in this case.

OPERATION

The various operations of interrupter 20 will now be described. In order to facilitate an understanding of these operations, they will be presented separately.

1. Manual Switch Opening

Figure 2:
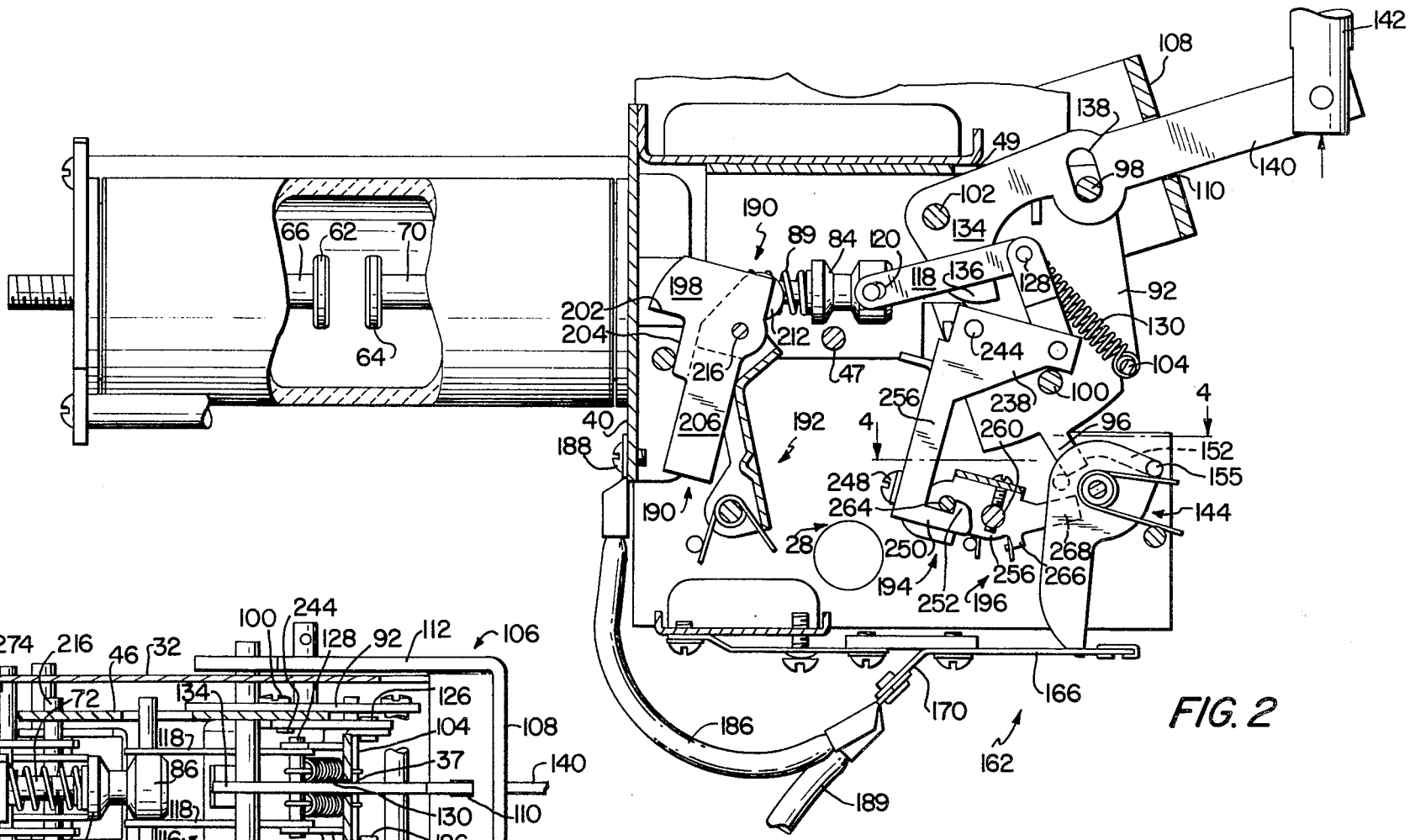
FIG. 2 is a view similar to FIG. 1, but with the operating mechanism shown in the switch open position thereof.
Figure 3:
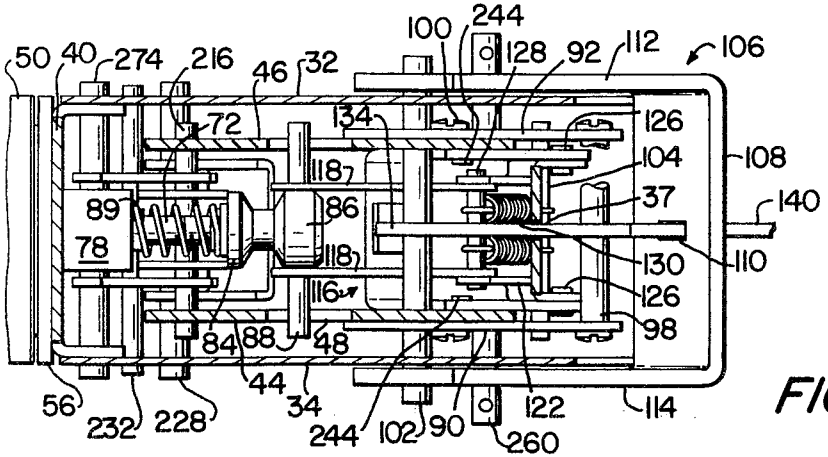
FIG. 3 is a horizontal sectional view taken along line 3—3 of FIG. 1.

In order to manually open the normally closed contacts 62, 64, it is only necessary to grasp handle 142 and move the same and plate 134 in a counterclockwise direction as viewed in FIG. 2. Such movement continues until pin 98 is engaged and sidewalls 90, 92 pivoted about pivot pin 102. Such motion continues until the toggle springs 130 pass the center line of the linkage 116 and links 122 strike spacer pin 100, thereby causing the linkage 116 to toggle and rapidly pull the moveable contact shaft 70 to the right as viewed in FIG. 2. Such rightward shifting continues until pin 88 strikes the rightmost end of the guide slots 48. (The slots 48 also prevent bending of the contact shaft 70.) Compression spring 89 assists the opening operation and in effect balances the atmospheric pressure force impeding opening imparted by the bellows 74. Moreover, the elongated slots 120 in the links 118 provide lost motion, thus imparting a hammer blow effect to rapidly accelerate the separation of the contacts 62, 64. Should these contacts be welded, the beak-like portion 136 of plate 134 will engage the pin 128 and apply force to the shiftable contact shaft 70, thus breaking the weld. As soon as toggling occurs, the sidewalls 90, 92 continue to move and cannot be restrained by virtue of the slot 138 in plate 134. In addition, counterclockwise movement of the plate is accommodated because of the slot 49 provided in bracket 42.

The slots 124 in the toggle links 122 allow the impact force generated when the spacer pin 100 strikes hammer 194 to be absorbed by the springs 130. Without the slots 124, this impact force is transmitted back through the hammer and into latch pin 264, causing the hammer to "bounce" out of the latch hook defined by dog 252.

2. Manual Closing

Movement of handle 142 in a clockwise direction serves to initially engage pin 98 and thereby pivots the sidewalls 90, 92 about pivot pin 102. Such movement continues until the springs 130 pass the center line of the linkage 116, causing the linkage to toggle over center and rapidly shift shaft 70 leftwardly as viewed in FIG. 2 until the contacts 62, 64 engage. However, during such closing movement the lever 190 comes into play to prevent undue deformation of the soft copper shafts 66, 70. Specifically, during the closing operation the flattened surface of segment 84 will initially engage the rounded portions 212 of the inboard walls 208, 210, thereby pivoting the lever 190 about support pin 216 as depicted in FIG. 8. Such contact occurs before the contacts 62, 64 engage, with the effect that the weighted lever 190 absorbs a considerable amount of the energy before the contacts actually close. In practice, it has been determined that without lever 190 an impact force of approximately 1250 lbs. is generated; with use of the lever however, the impact force is reduced to approximately 200 lbs. It will also be observed in FIG. 8 that during the energy absorbing sequence, bearing surface 204 contacts shaft 274, and that the righthand surface of the lever 190 engages bearing corner 226 forming a part of multiplier lever 192. Torsion spring 230 biases lever 192 in a counterclockwise direction and lever 190 in a clockwise direction against stop shaft 274, providing proper positioning for rounded portions 212 to be struck by segment 84 before the contacts 62, 64 close.

3. Fault-induced Operation

Referring to FIG. 6, when a fault current is experienced by bimetallic element 162 (or as a result of a significant rise in oil temperature), it will warp or deform downwardly to unlatch depending leg 148 of cam member 144. When this occurs, torsion spring 158 rotates the cam member 144 in a counterclockwise direction and brings the stud 154 into contact with arm 268 of hammer latch 196. This in turn causes latch 196 to pivot in a clockwise direction and move the pin 264 out of engagement with dog 252. This frees hammer 194 which rotates in a clockwise direction under the influence of the springs 130 and thereby pivots the links 220 coupled thereto in a clockwise direction. When the links 220 move through the center line of the springs 130, toggle linkage 116 collapses and quickly pulls the shaft 70 and contact 64 rightwardly as viewed in FIG.

6. Such movement is aided by the spring 89 as will be readily appreciated.

During the clockwise travel of hammer 190, the multiplier lever 192 is engaged, particularly at the area of stretch 224 thereof, and this serves to pivot the lever in a counterclockwise direction about the axis defined by shaft 228. Should the contacts 62, 64 not be welded together, counterclockwise pivoting of multiplier lever 192 serves to pivot weighted lever 190 about support pin 216 in a clockwise direction. Such movement of the lever 190 continues until the surface 204 engages shaft 274. At this point the multiplier lever 192 has shifted clear of the lower end of hammer 194, thus permitting the mechanism 116 to toggle as described. At the end of the rotation of the hammer 194, the ear 242 engages the rounded end of beak-like portion 136 of plate 134, causing the plate, arm 140 and handle 142 to move within slot 138 to an intermediate position, thus giving a visual indication of trip exteriorly of the tank 290.

In a situation where the contacts 62, 64 are welded together, the weld break hammer 194, multiplier lever 192, and weld break lever 190 come into play. In such a case (see FIG. 7) the screw 248 and thereby weight 246 firmly strike multiplier lever 192 at the angularly oriented stretch 224 thereof. This occurs prior to travel over center of the links 220. The force of impact of the hammer 194 against stretch 224 is multiplied and transmitted by dimple 222 to the weld break lever 190, the latter being in engagement with the flattened face of segment 84 as depicted. This serves to remultiply the impact force and pries the moveable contact 64 away from stationary contact 62, whereupon the links 220 move over center and opening occurs as hereinbefore described. In this connection, the described arrangement produced approximately a 10:1 mechanical advantage, and an opening force of approximately 1,000 lbs. on the segment 84; this force is sufficient to break any weld between the contacts 62, 64.

4. Reset After Fault-induced Tripping

After a fault current has been cleared, bimetallic element 162 quickly cools and assumes its normal latching position illustrated for example in FIG. 1. To reset interrupter 20, it is only necessary to grasp handle 142 and manipulate the same to rotate arm 140 and plate 134 in a counterclockwise direction. This serves to rotate the carriage sidewalls 90, 92 in a counterclockwise direction which pulls the springs 130 back over center of the toggle mechanism 116. At the same time, by virtue of the spacer 100, the hammer 194 is pivoted in a counterclockwise direction until dog 252 passes below and ultimately relatches with pin 264. At the same time, the reset leg 96 forming a part of sidewall 92 engages projection 152 on cam member 144, thereby rotating the cam member clockwise until leg 148 thereof passes between the spaced legs 164, 166 of the bimetallic element 162 and engages reinforcement 172. Switch closing is "trip-free" in that when the handle 142 is manipulated to rotate plate 134 and the over center toggle point is reached, movement to the fully closed position quickly follows, and cannot be held or impeded by the operator. This follows because of the provision of elongated slot 138 in plate 134.

5. Interphase Tripping

When interrupter 20 is used in a three-phase circuit (see FIG. 10), and the respective interrupters interconnected by means of linkage rods 284, operation in the trip mode of one interrupter serves to quickly operate the remaining two interrupters. This prevents single phasing of three-phase loads, which can damage or destroy downstream electrical equipment.

Specifically, in the event that one of the three ganged interrupters 20 experiences a fault current, operation thereof proceeds in the manner described above. However, as a consequence of such operation, the hammer latch 196 thereof is caused to rotate in a clockwise fashion. Inasmuch as the three latches 196 are coupled for rotation in unison via the linkage rods 284, it will be appreciated that the remaining two latches 196 will likewise rotate. This therefore frees all of the hammers 194 for contact-opening rotation thereof, thereby giving three-phase gang operation.

It will thus be seen that the present invention provides a greatly improved, resettable vacuum switch interrupter which also includes a current-sensitive fusing function. Operation of the interrupter is completely violence-free, does not contaminate surrounding dielectric material, and is capable of handling fault current loads above those that can be handled using conventional fuse links. Because the interrupter hereof can function both as a switch and a fuse, it can be equipped with a remotely operable actuating device so as to provide such functions as remote load shedding or emergency-preferred transfer schemes. Further, in the three-phase contexts the interrupters can be gang-coupled for operation in unison, to prevent single phasing of the three-phase load.

In combination with a CLF, the interrupter of the invention gives a desirably coordinated full range protective device of special utility in liquid dielectric situations, although use of the combination is not so limited. As noted, use of the combination in distribution switchgear apparatus gives numerous operational advantages without sacrifice of system coordination.

Having thus described the invention, what is claimed as new and desired to be secured by Letters Patent is:

1. A current interrupting device adapted to be interposed in an electrical circuit to protect the same from the effects of fault currents, comprising:

a tank adapted to hold a quantity of fluid dielectric material and circuit protecting means immersed within said dielectric material and including a current responsive low fault range vacuum interrupter including means defining a substantially evacuated chamber, a pair of normally closed electrical contacts within said chamber, and mechanism for opening said contacts in response to a relatively low magnitude fault current experienced by said circuit, said mechanism comprising a motive assembly operatively coupled to one of said contacts and shiftable between a cocked position and a tripped position, a heat responsive latching element for releasably holding said motive assembly in said cocked position thereof and for delatching of the motive assembly upon heating of the latching element, and means for heating said latching element and consequent delatching of said motive assembly in response to a relatively low magnitude fault current experienced by said circuit, a current limiting fuse including a sealed housing and a fusible element within the housing which fuses in response to a relatively high magnitude fault current experienced by said circuit, said housing including structure for retaining the energy of interruption within the housing upon fusing of said fusible element;

means mounting said latching element out of engagement with and in physically spaced relationship from said current limiting fuse, and with said fluid dielectric material interposed in the zone between said current limiting fuse and latching element; and means electrically connecting said vacuum interrupter and current limiting fuse in series.

2. The device as set forth in claim 1, said vacuum interrupter including means for manual opening and closing of said contact pair as desired.

3. The device as set forth in claim 1, said mechanism including a motive assembly operably coupled to one of said contacts and shiftable between a cocked position and a tripped position, and a latching element electrically coupled in series in said circuit for releasably holding said motive assembly in said cocked position thereof, and for unlatching the motive assembly in response to a relatively low magnitude fault current experienced by said circuit.

4. The device as set forth in claim 3, including reset means for shifting said motive assembly from said tripped position to said cocked position, and for relatching of the motive assembly with said element.

5. The device as set forth in claim 3, said element being constructed for heating in response to said low magnitude fault current, and, in response to and as a direct result of said heating, for changing its configuration to accomplish said unlatching.

6. The device as set forth in claim 5, said element comprising a heat deformable bimetallic component.

7. The device as set forth in claim 5, said element being in series with said normally closed contacts.

8. The device as set forth in claim 5 including a current transformer operably coupled with said element for limiting the maximum current which can be experienced by said element, said transformer having a primary winding and a secondary winding, said windings being electrically coupled in series with said circuit.

9. The device as set forth in claim 5 including a shunt resistor electrically coupled in parallel with said element.

10. The device as set forth in claim 1, there being a shaft secured to a shiftable one of said contacts and extending out of said chamber, and weld breaking means comprising:

a weld breaking lever including structure for engaging said shaft;

means pivotally mounting said lever for movement thereof in a direction to move said shaft for opening of said contacts;

hammer means;

means shiftably mounting said hammer means for movement thereof between a cocked position and a hammering position for moving the weld breaking lever in said direction for said opening of the contacts;

means for biasing said hammer means for movement thereof from said cocked position to said hammering position; and means for releasably holding said hammer means in said cocked position thereof, and for releasing the hammer means upon operation of said mechanism.

11. The device as set forth in claim 10 including a second, pivotally mounted, multiplier lever adjacent to and engageable with said weld break lever and including a hammering surface, said hammer means being configured for striking said surface in the hammering position thereof.

12. The device as set forth in claim 1, said dielectric material being oil.

13. An electrical interrupter device adapted to be interposed in an electrical circuit, comprising:

a vacuum contact assembly including means defining a substantially evacuated chamber and a pair of normally closed electrical contacts within said chamber, at least one of said contacts being shiftable for opening and closing of the contact pair to alternately interrupt and establish a current path through the contact pair;

means for electrically connecting said contact pair in series with said electrical circuit;

mechanism operably coupled to said assembly for opening said contact pair when said circuit experiences a fault current of a predetermined magnitude, said mechanism including a heat responsive bimetallic latching element electrically coupled in series in said circuit, said element being constructed for heating in response to a fault current of said predetermined magnitude experienced by said circuit, and, in response to and as a direct result of said heating, for changing its physical configuration for unlatching said mechanism and permitting said opening of said contact pair;

a shaft secured to a shiftable one of said contacts and extending out of said chamber; and weld breaking means, including— a weld breaking lever including structure for engaging said shaft;

means pivotally mounting said lever for movement thereof in a direction to move said shaft for opening of said contacts;

hammer means;

means shiftably mounting said hammer means for movement thereof between a cocked position and a hammering position for moving the weld breaking lever in said direction for said opening of the contacts;

means for biasing said hammer means for movement thereof from said cocked position to said hammering position; and means for releasably holding said hammer means in said cocked position thereof, and for releasing the hammer means upon operation of said mechanism.

14. The device as set forth in claim 13 including structure for selective manual opening and closing of said contact pair.

15. The device as set forth in claim 13 including a tank surrounding said device and normally filled with a liquid dielectric material, said device being immersed in said dielectric material.

16. The device as set forth in claim 13, said element further being constructed for returning to its original physical configuration when said heat is dissipated.

17. The device as set forth in claim 16, said mechanism including a motive assembly operably coupled to one of said contacts and shiftable between a cocked position and a tripped position, said latching element normally serving to releasably hold said motive assembly in said cocked position thereof.

18. The device as set forth in claim 17, including reset means for shifting said motive assembly from said tripped position to said cocked position, and for relatching of the motive assembly with said element.

19. Coordinated full range circuit protecting means adapted to be interposed in an electrical circuit to protect the latter from the effects of fault currents, comprising:

a current responsive low fault range vacuum interrupter including means defining a substantially evacuated chamber, a pair of normally closed electrical contacts within said chamber, and mechanism for opening said contacts in response to a relatively low magnitude fault current experienced by said circuit;

a current limiting fuse including a housing and a fusible element within the housing which fuses in response to a relatively high magnitude fault current experienced by said circuit;

means electrically connecting said vacuum interrupter and current limiting fuse in series, said mechanism including structure coupled in electrical series with said fusible element for operating the mechanism to open said contacts upon experiencing the let through current resulting from the operation of said series-connected current limiting fuse, such that said vacuum interrupter will operate in response to operation of the current limiting fuse.

20. Circuit protecting means as set forth in claim 19, said structure including a latching element electrically coupled with said current limiting fuse, said element being constructed for heating in response to a fault current of a predetermined level experienced by said circuit, and, in response to and as a direct result of said heating, for changing its physical configuration for unlatching said mechanism and permitting said opening of said contact pair.

21. In an electrical interrupter adapted to be interposed in an electrical circuit including a pair of normally closed electrical contacts, a shaft secured to one of the contacts, and mechanism operably coupled with said shaft for shifting said one contact to open said contact pair in response to a fault current experienced by said circuit, the improvement of means for breaking a weld between said contacts, comprising:

a weld breaking lever including structure for engaging said shaft;

means pivotally mounting said lever for movement thereof in a direction to move said shaft for opening of said contacts;

hammer means;

means shiftably mounting said hammer means for movement thereof between a cocked position and a hammering position for moving the weld breaking lever in said direction for opening of the contacts;

means for biasing said hammer means for movement thereof from said cocked position to said hammering position; and means for releasably holding said hammer means in said cocked position thereof, and for releasing the hammer means upon operation of said mechanism.

22. The interrupter as set forth in claim 21, including a second, pivotally mounted, multiplier lever adjacent to and engageable with said weld break lever and including a hammering surface, said hammer means being configured for striking said surface in the hammering position thereof.

23. The interrupter as set forth in claim 22 including means defining a substantially evacuated chamber receiving said contacts, said shaft extending out of said chamber.

24. A current interrupting device adapted to be interposed in an electrical circuit to protect the same from the effects of fault currents, comprising:

a tank adapted to hold a quantity of fluid dielectric material; and circuit protecting means immersed within said dielectric material and including— a current responsive low fault range vacuum interrupter including means defining a substantially evacuated chamber, a pair of electrical contacts within said chamber and mechanism for opening said contacts in response to a relatively low magnitude fault current experienced by said circuit, said mechanism including a motive assembly operatively coupled to one of said contacts and shiftable between a cocked position and a tripped position, and a latching element electrically coupled in series in said circuit for releasably holding said motive assembly in said cocked position thereof, and for unlatching the motive assembly in response to a relatively low magnitude fault current experienced by said circuit, said element comprising a heat deformable bimetallic component constructed for resistance heating in response to experiencing said low magnitude fault current, and, in response to and as a direct result of said heating, for changing its configuration to accomplish said unlatching;

a current limiting fuse including a housing and a fusible element within the housing which fuses in response to a relatively high magnitude fault current experienced by said circuit; and means electrically connecting said vacuum interrupter and current limiting fuse in series.

25. The current interrupting device as set forth in claim 1, said latching element being electrically coupled in series in said circuit for resistance heating thereof in response to said relatively low magnitude fault current.

* * * * *